US006233976B1

(12) United States Patent
Roell

(10) Patent No.: US 6,233,976 B1
(45) Date of Patent: May 22, 2001

(54) SHAPING/AUGMENTING/DIMINISHING KNITTED FABRICS

(75) Inventor: Friedrich Roell, Biberach (DE)

(73) Assignee: Recaro GmbH & Co., Kirchheim-Teck (DE)

( * ) Notice: Subject to any disclaimer, the term of this patent is extended or adjusted under 35 U.S.C. 154(b) by 0 days.

(21) Appl. No.: 09/511,199

(22) Filed: Feb. 23, 2000

Related U.S. Application Data

(62) Division of application No. 09/171,371, filed on Mar. 8, 1999, now Pat. No. 6,116,057.

(30) Foreign Application Priority Data

Apr. 18, 1996 (DE) ..... 196 16 003

(51) Int. Cl.[7] ..... D04B 7/10
(52) U.S. Cl. ..... 66/70; 66/64; 66/76
(58) Field of Search ..... 66/64, 60 R, 70, 66/71, 73, 67, 76, 75.1, 77

(56) References Cited

U.S. PATENT DOCUMENTS 3,800,560 * 4/1974 Hanney et al. ..... 66/14
5,308,141 * 5/1994 Robinson et al. ..... 66/200
5,326,150 * 7/1994 Robinson et al. ..... 66/200

FOREIGN PATENT DOCUMENTS

562751 * 8/1930 (DE) ..... 66/202
3937406 * 5/1991 (DE) ..... 66/202

* cited by examiner

*Primary Examiner*—Danny Worrell
(74) *Attorney, Agent, or Firm*—Smith-Hill and Bedell

(57) ABSTRACT

The present invention relates to a method of producing three-dimensional knits. In accordance with the invention narrowing the loops is done by loops covering a partial area of the needle bed being transferred to needles arranged nearer to the middle of the knit and subsequently knitting further continued, and widening the loops is done by loops covering a partial area of the needle bed being transferred to needles arranged remote from the middle of the knit and subsequently knitting further continued. As an alternative to this, needles may be rendered inactive in a partial area of the needle bed over at least one course and subsequently reactivated.

19 Claims, 5 Drawing Sheets

SHAPING/AUGMENTING/DIMINISHING KNITTED FABRICS

CROSS-REFERENCE TO RELATED APPLICATION

This application is a divisional of U.S. patent application Ser. No. 09/171,371 filed Mar. 8, 1999, now U.S. Pat. No. 6,116,057.

The present invention relates to a method of producing a three-dimensional knit. In fashioning, needles are made inactive in predetermined sections of the needle bed and reactivated after a predetermined number of loops. The non-inactivated, i.e. fully knitted, portions bulge since on reactivation of the inactivated needles they are puckered by the interlooped courses in the inactivated portions between which one or also more courses of the fully knitted portion may be arranged. This inactivation/activation may also be achieved staircased, i.e. sectionwise from one course to the other so that knits materialize in a predetermined shape which may be used e.g. as preformed seat covers.

The method of producing three-dimensional knits by means of fashioning reads from claim 7. Advantageous further aspects of the method read from the corresponding sub-claims.

A first method of producing three-dimensional knits consists of the widening/narrowing technique. Widening in this sense involves forming two wales from a single wale at an optional location in the knit, it thus involving a widening of the knit. In a first embodiment of the widening technique the loops at least on one side of the widening location are shifted outwards by the desired widening width. In an alternative embodiment of the technique loops are knitted separately in two needle regions and subsequently interlinked by transferring at least one region.

Whilst the known loop widening/narrowing technique in the marginal portion of a knit merely results in contouring of the knit, but not in three-dimensional shaping, in widening/narrowing in the knit in accordance with the invention additional loops are introduced into the knit or taken out of the knit, resulting in a shaping of the knit and thus in a three-dimensional shaping. The narrowing technique represents precisely the opposite procedure. In the narrowing technique at least two wales are combined into a single wale, this procedure involving transferring loops on at least one side of the knit further inwards so that the resulting gap is closed. This technique too, may be continued successively over several courses so that desired bulged portions may be generated. One possibility of bulging involves e.g. first implementing the widening and then the narrowing technique, resulting in a bulge due to an excess of material being obtained in the widening/narrowing region. Another technique first applies narrowing followed by widening to the original number of loops, as a result of which a deficient amount of material occurs in the narrowing/widening region which in turn results in a deformation of the knit as a whole and thus in three-dimensional shaping.

Transferring the loops is preferably implemented as follows: The loops are transferred from an active needle bed to an auxiliary needle bed. The auxiliary needle bed which, among other things, may also be an active needle bed is then shifted relative to the active needle bed. Subsequently the loops are transferred back at a shifted location to the auxiliary needle bed. Although this method is thus rather complicated as regards the machine action sequence, it permits production of three-dimensional knits with possibilities hitherto not available.

Another method of producing three-dimensional knits consists of making needles inactive in specific portions of the knit, whilst knitting is continued with the needles in the other portions. By later activating these inactivated needles, e.g. after one or more courses, a puckering of the knit is achieved in this inactivated portion which again may be made use of as desired in achieving specific shapes. When needles are made inactive e.g. for a knit in the marginal portions of the flat knitting machine and this inactivation repeated on a spacing of a few courses differing in width, then a spherical structure is attained having a highly homogeneous structure. In this case too, inactivating the needles should take place only over a few courses so that excessive deformations of the knit at any one location is avoided. Further, the width (number of needles) involved in inactivation may be alternatingly changed so that here too, a distribution of the deformed locations may be achieved in the shaping portion. These locations are located at points at which an inactivated portion adjoins an fully knitted portion.

Both of the principle techniques of producing geometrical knits as cited above may be achieved by the method in accordance with the invention in that the widening/narrowing of the loops, on the one hand, or inactivating needles, on the one other, is distributed to many locations in the deformation portion. In any case, for one thing, a more homogeneous structure of the three-dimensional knit is achieved which, for another, incorporates improved mechanical properties.

In both the fashioning and the widening/narrowing technique portions occur which, as compared to normally knitted portions, are altered, be it by this portion being made inactive over several courses or be it that wales are generated at a specific location or removed by combining wales. At these locations inhomogenities occur as a rule in the knit, these inhomogenities involving in part the formation of "holes" at the transit locations.

In accordance with a further aspect of the invention in addition to the interlooping yarn weft and/or warp yarns are incorporated in this portion which result in the portion being reinforced, and for anothing thing, the holes at inhomogeneity locations being closed. This reduction in the size of the holes may be improved, among other things, by making use of weft and/or warp yarns of an elastic material, such as e.g. rubber yarns.

In the case of the fashioning technique it is e.g. of advantage when a weft yarn is placed in at least one, preferably both, courses defining an inactivated portion. As regards the adjacent fully knitted courses, this weft yarn may run without binding, although it may be placed on tuck or linked in some other way, however. What is achieved in any case is that the hole formation at point of contact between the activated portion and non-activated portion is puckered or closed and is thus hardly discernible any more as a inhomogeneity.

Another possibility of reducing inhomogenities both in widening/narrowing and in fashioning consists of splitting loops in the region of the inhomogeneity, i.e. producing two loops from a single loop, e.g. by looping on a further needle bed, these two loops making for a better fill in the region of the inhomogeneity of the knit and a better join between differing portions, e.g. in the activated and non-activated region in fashioning. Widening loops also achieves a more homogeneous surface free of holes when a split loop is placed in the new empty needle in the knit.

A further technique of reducing the holes in inhomogeneity locations in widening/narrowing/fashioning relative to normal knit is to lay one or more marginal loops to tuck in this region of the inhomogeneity.

In conclusion a special technique of reducing the holes exists for fashioning technology, especially in the case of staircase fashioning, i.e. in which the width of inactivation from one course to another or also from one course portion to another is altered.

One possibility consists of knitting one or more additional (horizontal) loops onto the outermost loop prior to a loop inactivation, which is/are then including in the knit on later activation. In this way a greater volume is achieved in the inactivated portion. A similar effect may be achieved also by not inactivating the outermost needle of the portion to be inactivated over a course so that an additional vertical loop is achieved, contrary to a further horizontal outer loop when an additional outer loop is knitted into the last active courses. Here too, several vertical loops may be attached. Both techniques result in an increase in volume at the fashioning line, i.e. the line in which the last course prior to the inactivated portion is joined to the first course after inactivation.

This technology may, of course, also be made use of to join knit sections of any shape to each other as will be detained later in describing an example. The techniques as described above for including weft and/or warp yarns, tucking loops, splitting loops and knitting additional horizontal or vertical loops may find application in all procedures such as fashioning, widening and narrowing, in combination, where required, to obtain in particular a dense and homogeneous widening/narrowing line or fashioning line in staircase-type widening/narrowing or staircase-type fashioning respectively.

In the region of the inhomogeneity the loops may be knitted specifically more firmly to obviate hole formation in this portion.

When twin needles are employed, knitting may be done with the A needle in the complete knitted portion whilst in the region of the inhomogeneity knitting is done with the A and B needle to increase the knit density in this portion. In the same way, knitting may be done with a finer needle in the region of the inhomogeneity.

The techniques as described above are excellently suitable for producing all kinds of shaped industrial knits, in particular seat covers, headrest covers, armrest covers and fiber composite moldings.

The techniques of the present invention will now be described by way of an example in the following with reference to the schematic drawing in which.

Figure 3:
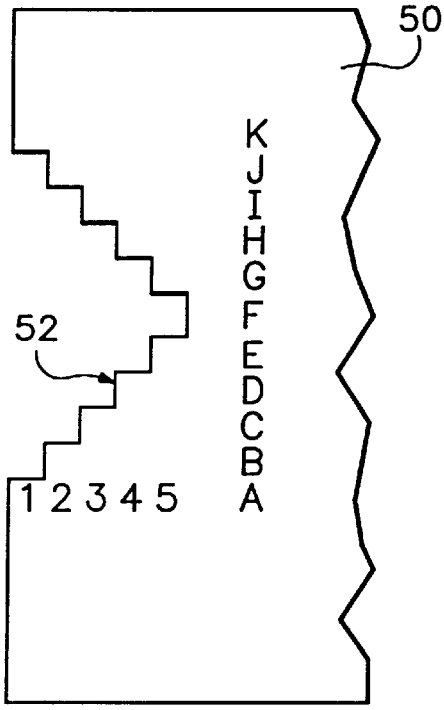
Figure 4:
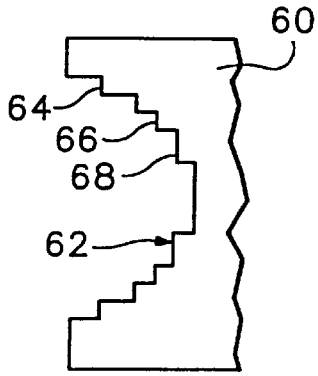
Figure 5:
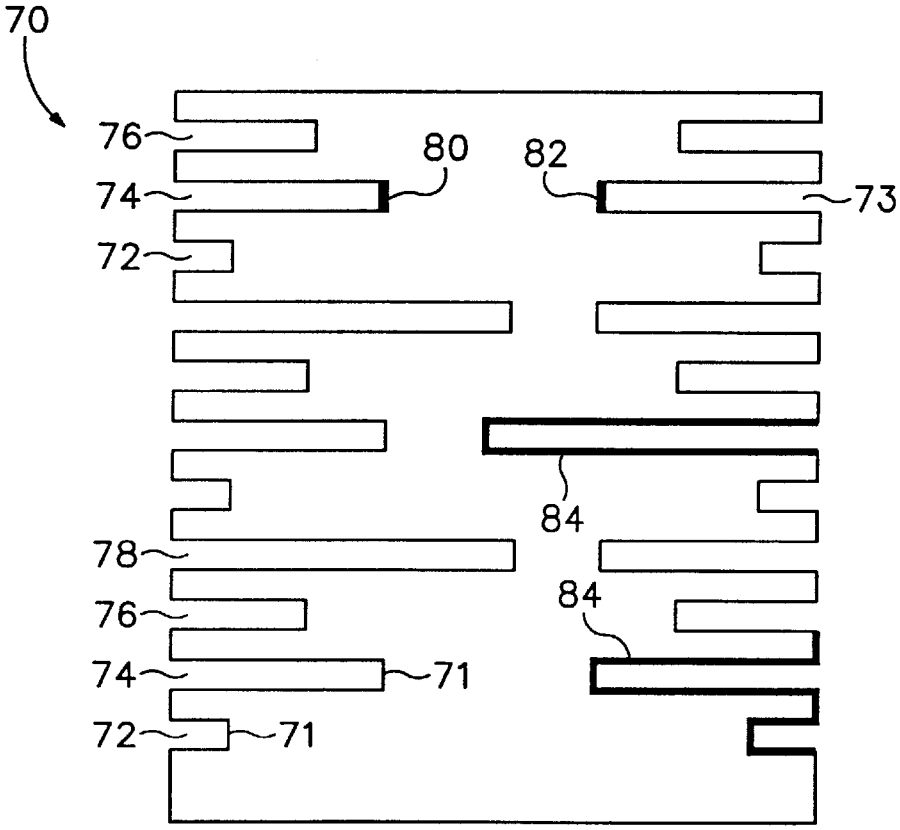
Figure 6:
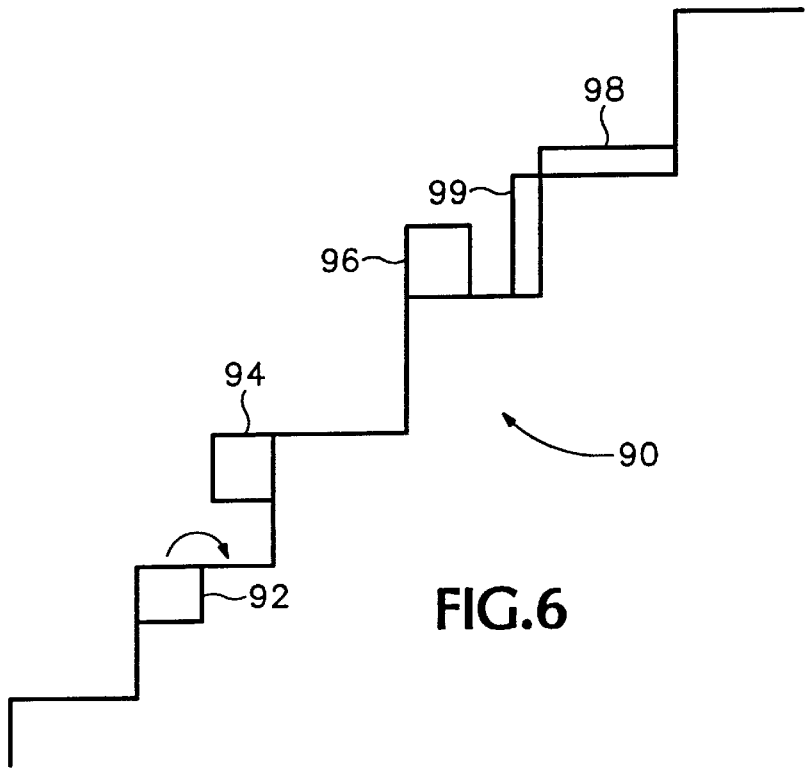
Figure 7:
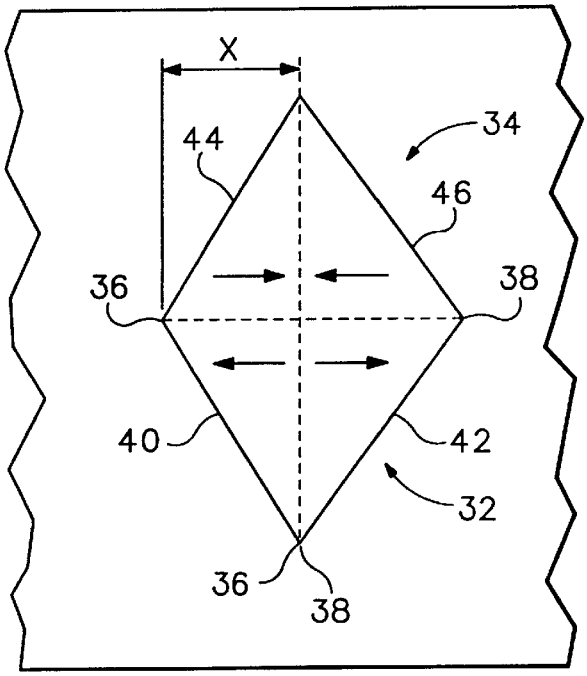
Figure 9:
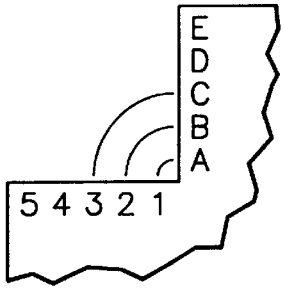
Figure 8:
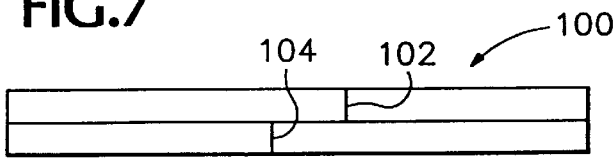
Figure 10A:
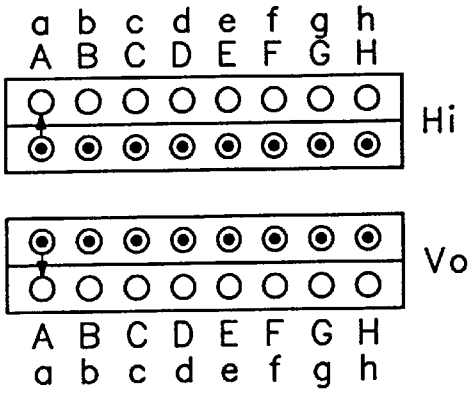
Figure 10D:
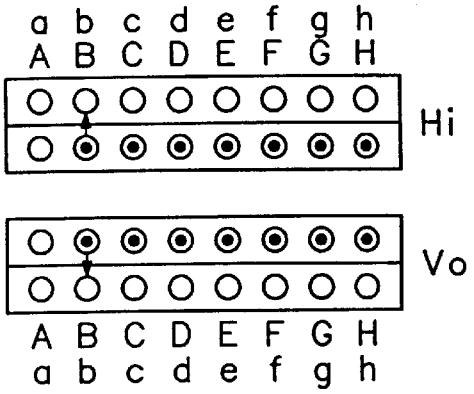
Figure 10B:
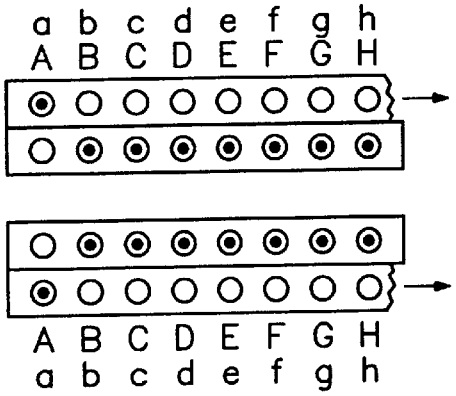
Figure 10E:
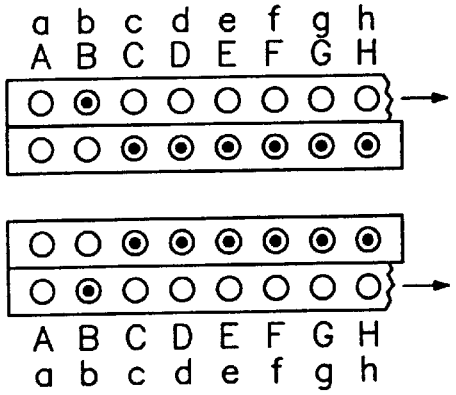
Figure 10C:
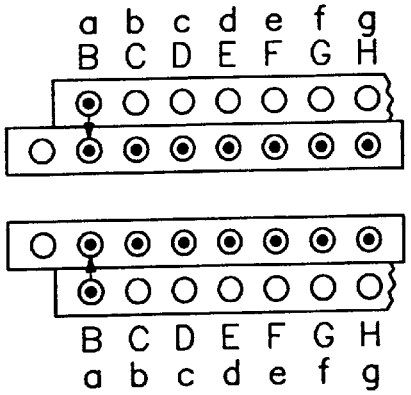
Figure 10F:
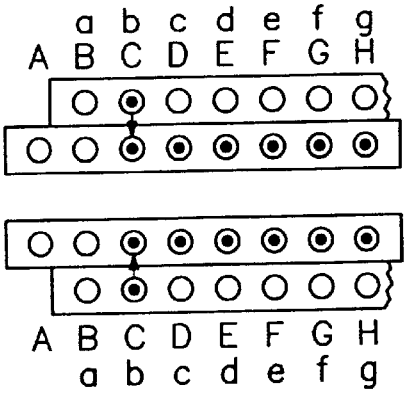
Figure 11A:
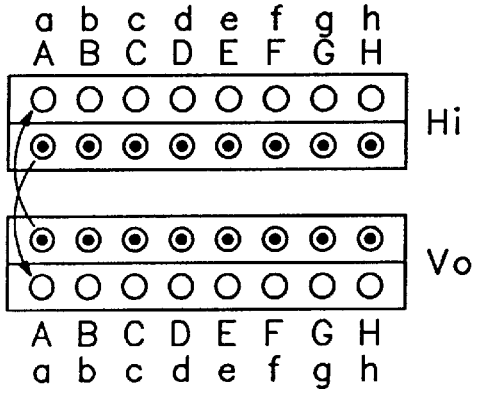
Figure 11B:
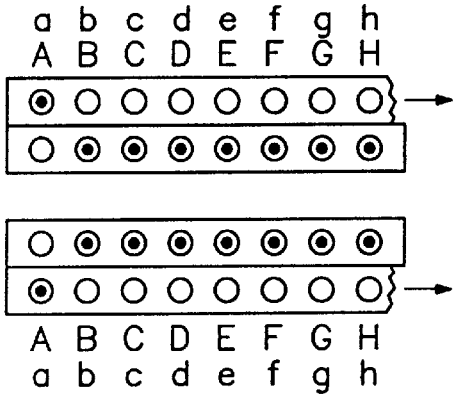
Figure 11C:
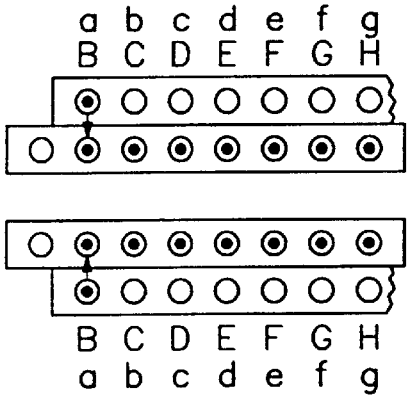
Figure 11D:
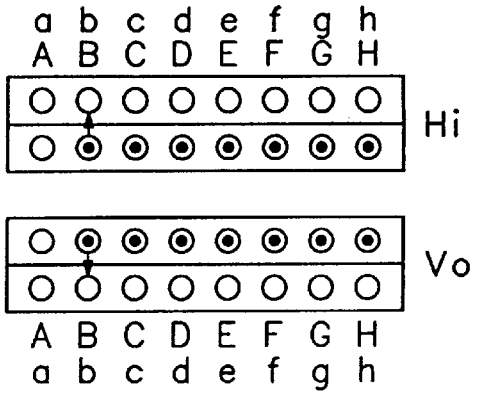
Figure 11E:
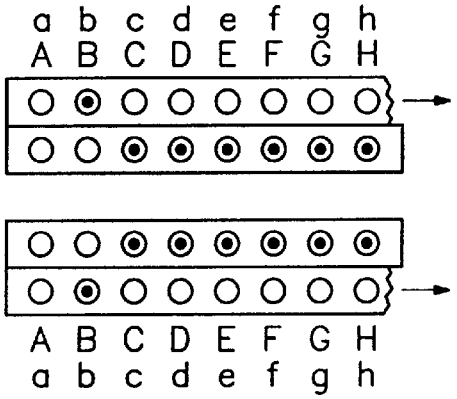
Figure 11F:
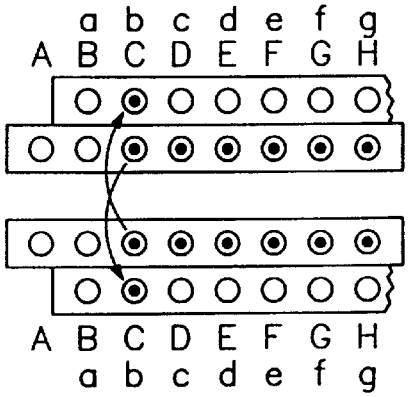

FIG. 3 is an illustration of a staircased fashioning line having straight edges, FIG. 4 is an illustration of a staircased fashioning line having curved edges, FIG. 5 is an illustration of a knit pattern having inactivated portions for producing a balaclava helmet, FIG. 6 is an illustration of various possibilities of reducing inhomogenities at an edge, FIG. 7 is an illustration of a knitted piece having widening and narrowing, FIG. 8 is an illustration of a two-ply knit in which the fashioning edge or the widening/narrowing edge is offset in both plies, FIG. 9 is an illustration of a corner fashioning line, FIG. 10 is an illustration of a needle scheme for narrowing in the case of a double-planar knit, and FIG. 11 is an illustration of a further needle scheme for an alternative narrowing in the case of a double-planar knit.

Figure 1:
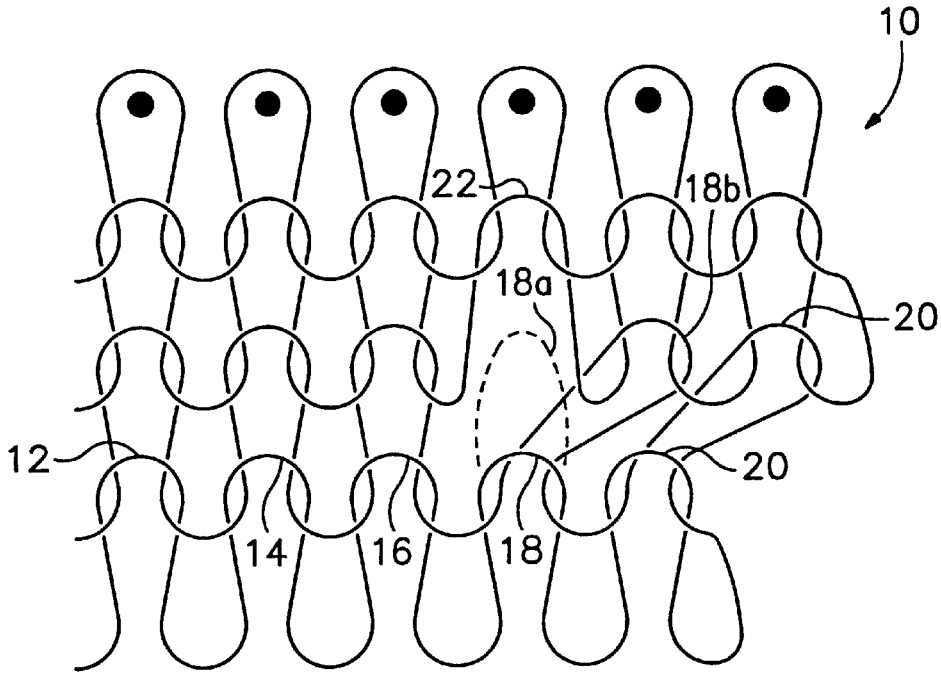
FIG. 1 is an illustration of a loop construction in widening.

Referring now to FIG. 1 there is illustrated a loop construction of a knit 10, the width of which has been increased by widening a loop. In commencing chronologically with the widening method it is evident that in the lowest course five loops 12, 14 16, 18, 20 hung on five needles. In the course knitted thereafter, the loops 18 and 20 were shifted one loop to the right, as a result of which the third needle from the right in this course remained free. In the course following that an interlooping yarn is also fed to this free needle, so that the knit in the last but one course already comprises one loop more.

It is evident that in the second course, in which the loops 18 and 20 have been shifted outwardly by one needle, a relatively large gap remains, resulting in an inhomogeneity of knit in the form of a hole. It is now possibile, before shifting the loops 18 and 20, to split the loop 18 to needles located outwards so that in subsequently shifting the loops 18 and 20 to needles located outward the one split loop 18*a* is hung in the same needle as for the loop 18 hitherto, whilst the other split loop 18*b* is hung by one needle further to the right. It is obvious that by this splitting of the loop in the widening portion the resulting hole may be filled very well so that the inhomogeneity in the knit in widening loops is hardly discernible. For splitting the loop, in looping the loop 18 prior to widening, a first split loop 18*a* is generated on the active needle bed whilst a second auxiliary loop 18*b* is generated on an auxiliary needle bed or further active needle bed. This auxiliary needle bed may be definitely to advantage the needle bed by which the outer loops 18 and 20 are hung outwardly. The loop 20 generated on the active needle bed is also transferred to the auxiliary needle bed and the two loops 18*b* and 20 present on the auxiliary needle bed are displaced by laterally shifting the auxiliary needle bed or other active needle bed relative to the first active needle bed by one needle outwardly, after which the loops 18*b* and 20 are hung back from the auxiliary needle bed to the active needle bed.

Figure 2:
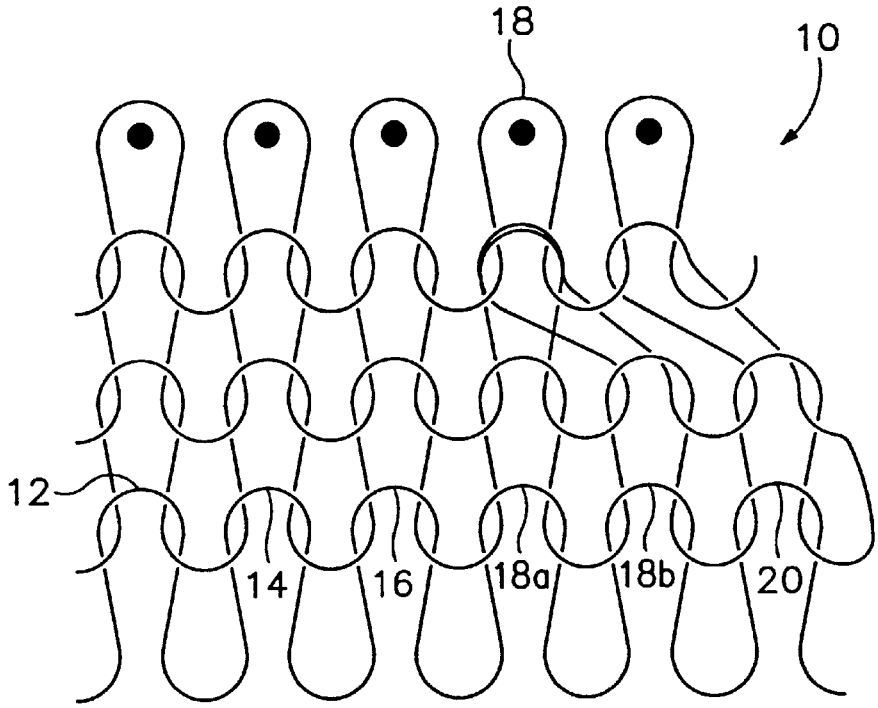
FIG. 2 is an illustration of a loop construction in narrowing.

Referring now to FIG. 2 there is illustrated the knit 10 as shown in FIG. 1 in the portion of the narrowing about one loop. The Figure shows in the first two courses the six loops 12, 14, 16, 18*a*, 18*b* and 20 resulting from the widening as shown in FIG. 1. In the last but one course as shown in FIG. 2 the loops 18*a* and 18*b* are hung together on a needle, as a result of which in the case of the further knitting, the two loops 18*a* and 18*b* hanging together on one needle in the last course are combined into the loop 18. This procedure thus represents the inverse procedure as shown in FIG. 1. Combining the loops 18*b* and 18*a* involving a displacement of the loops 18*b* and 20 by one needle to the left, will now be described in brief. The loops 18*b* and 20 are transferred to an auxiliary needle bed or to some other active needle bed. This needle bed or other active needle bed is subsequently shifted by one needle to the left, and the loops 18*b* and 20 hooked back. Since the loop 18*a* is still hanging on the left-hand needle of the two needles of the active needle bed, the loops 18*a* and 18*b* are thus combined and replaced by a loop on feeding of the next interlooping yarn 18.

Referring now to FIG. 7 there is illustrated a knit 30 comprising firstly a widening portion 32 extending in the wale direction and then a narrowing portion 34 extending in the wale direction, both portions 32, 34 being characterized by two loops being widened (32) or narrowed (34) in each course or every second course. The technical aspects of the knitting procedure will now be detailled. The corner loops 36 and 38 of the knit hang on adjacent needles, widening occurs by the loops being displaced outwards by one loop on both sides of the loop 36, 38 after every course or every second course. This outward displacement has already been described in conjunction with FIG. 1. Due to this outward displacement two needles become free in the interior which are to be occupied with new loops on supply of the next interlooping yarn, thus resulting in each course or all two courses producing two new loops in the interior, i.e. the knit becoming continually wider in the portion of the widening 32 until on each side of the edge 40, 42 x new loops have been knitted in addition. At the end of the widening portion 32 the knit 30 has accordingly twice as many loops as at the start. These twice as many new loops hang between the original loops 36, 38 which hung juxtaposed on the needle bed at the start of the knit. In the narrowing portion the procedure is the reverse. Along the edges 44, 46 two loops are combined into one in every course or in every second course as described in conjunction with FIG. 2. This procedure is repeated x times so that on both sides of the edges 40, 46 x loops are removed in each case, and the knit 30 at the upper end again has the same width as at the start. At the end of the narrowing 34 the two loops 36, 38 thus again hang juxtaposed. It will readily be appreciated that the knit 30 in the portion between the widening 32 and the narrowing 34 is strongly bulged since the knit in this portion comprises very many more loops than in the upper and lower marginal portion at the start of widening or end of the narrowing 34.

Referring now to FIG. 7 there is illustrated a fashioning line within which a knit piece is additionally inserted in a knit, it being, of course, possibile to first knit the narrowing portion and then the widening portion, resulting in a "cut-out" fashioning line.

It is alternatively possible to produce the widening by knitting the loops from the margin up to the loops 36 or 38 on separately sections of the needle bed and subsequently hanging them together and joining them to each other, e.g. by interlooping or side tuck loops.

Referring now to FIG. 3 there is illustrated a knit 50 having a staircased fashioning line 52. In the region of the staircased fashioning line 52 a three-dimensional shape of the knit 50 is then achieved by needles on the left-hand edge of the knit being made inactive so that no knitting is done in this portion over one or more rows of needles. During inactivation, the inactivated needles receive no interlooping yarn, so that the loops remain hanging on these needles prior to inactivation of the needles. In later reactivation of the needles the new loops are then joined to the loops last knitted prior to inactivation of the needles, as a result of which, the loops before and after the inactivated portion are simply knitted together, resulting in the knit being puckered in this portion corresponding to the number of non-knitted courses. In one course loops are thus present which were knitted earlier by quite a few courses. The staircased fashioning line will now be explained in detail. In the course A all needles are still active. In the course B needle 1 is made inactive so that loops A1 and B2-*n* now hang on the needles. In the course C the needles 1 and 2 are made inactive, the loops A1, B2 and C3-*n* then hanging on the needles. In the course F the loops A1, B2, C3, D4, E5 and F6-*n* are hanging on the needles. In the courses G to K the inactivated needles are successively reactivated beginning from the right. In course G the loops A1, B2, C3, D4 and G5-*n* are then hanging on the needles. In the course H the loops hanging are A1, B2, C3 and H4-*n*. In the course J the loops hanging are A1 and J2-*n* and in the course K only the loops of the course K are still hanging, i.e. K1-*n* on the needles, with which the fashioning line is finish-knitted. The shape of the knit 52 by the fashioning line 52 may be visualized by imagining a cloth from which one corner has been cut off at the side in the form of the staircased fashioning line 52 and the cut edges subsequently joined to each other.

The fashioning technology is, of course, not confined to the fashioning line as shown in FIG. 3. Thus, e.g. several needles may be made inactive/active per course, resulting in highly moderate deformations. However, the steps of the staircase may also be several courses high, resulting in a very strong deformation of the knit. In this way all desired deformations of the knit may be achieved as regards producing a three-dimensional knit.

Referring now to FIG. 4 there is illustrated a knit 60 having a fashioning line 62 comprising low steps 64 (one course high, two courses wide) towards the start and end. In the transition the steps 66 are normally high (one course high, one loop wide) and translate in the middle into higher steps 68 (two courses high, one course wide). It is evident from FIG. 4 how strongly the shape of the fashioning line and thus the nature of the deformation may already be modified by varying the step height by one course and varying the step width by one loop. Variation is, however, possible within very broad limits, e.g. over almost the full knit width and over a height of up to ten courses.

Referring now to FIG. 5 there is illustrated a knitting scheme for producing a more or less spherical knit, the Figure showing in this respect the actually knitted textile area 70. Shaping the textile is achieved by rendering the needles inactive in differing spacings and in a differing width within a portion of the textile area on both sides. Evident from FIG. 5 below on the left are the needles inactivated in a first portion 72 covering, for example, only 20 needles. A couple of courses later the needles are rendered inactive in a portion 74 extending over the width of 60 needles. Again, a couple of courses later, the needles are activated over a width 76 which lies between the two aforementioned widths, e.g. needles. Other portions 78 are so wide that these portions overlap from both sides of the knit. The points at which a deformation of the knit 70 thereby occurs are the points 71 at which the inactivated portions 72 to 78 adjoin the fully knitted portions. This is why the width of the inactivated portions, i.e. the number of inactivated needles is continually varied so that the deformation points 11 are also distributed homogeneously within the deformation portion b. It is in this way that a defined structuring of the narrowing is further avoided which in turn would involve a weakening of the knit. The mutual spacing of the inactivations 72, 74, 76, 78 is relatively constant so that the deformation points 71 comprise in the looping direction a more or less homogeneous spacing. Accordingly, the deformation points 11 are homogeneously distributed in the knit 70. It will readily be appreciated from FIG. 5 that the portions non-knitted by the needles being made inactive become wider outwardly. When now envisaging that the top and bottom edges of the inactivated portions 72 to 78 are joined to each other by their top and bottom edges it will be readily understood that the knit 70 as shown in FIG. 5 has in reality an approximately spherical shape. The degree of deformation is set by the spacing, i.e. the sequence of inactivation and the width of the inactivated portions 72 to 78, i.e. the wider and higher the inactivated portions and the inactivated sequence the greater is the deformation.

The inhomogenities 71 occurring in the marginal portion of the inactivations are undesirable since they result in the mechanical stability being diminished and/or in the appearance of the knit being spoiled. To minimize the inhomogeneity of the knit in the marginal portion of the inactivated sections there are various possibilities, thus in the case of the knit 70 the marginal loop 80 of the fully knitted portion adjoining the second inactivated portion 74 on the left at the top is placed to tuck. In the portion 73 of the opposite inactivation a loop is split 82 in the marginal portion between the active and inactivated portion on the right-hand side so that a hole resulting from the inhomogeneity, as already shown in FIG. 1, may be concealed.

Another possibility of reducing inhomogenities consists of including a weft yarn 84 at least in the course before and after an inactivated section. In this way the knit is reinforced about the inactivated section. When the weft yarn 84 consists of a flexible material the knit may be puckered about the region of the inhomogeneity.

Referring now to FIG. 6 there is illustrated a section of a fashioning edge 52 on a magnified scale as shown in FIG. 3 or of a widening/narrowing portion 32, 34 as shown in FIG. 7. The possibilities of reducing the inhomogeneity resulting in the case of a fashioning line or in a widening/narrowing in the region of the fashioning edge and widening/narrowing edge respectively will now be discussed with reference to FIG. 6.

In FIG. 6 the steps of the staircase 90 are two courses high and two loops wide. However, the techniques as described for reducing inhomogenities at the edge may also be applied to steps having a height and width which is less or more.

In the case of a two-ply knit, for instance, the margin loop 92 may be hung onto the next lower staircase loop on the front needle bed, whilst in the next higher staircase loop it is hung in the rear needle bed. There is in addition the possibility of crossing the hung loops of both beds, as a result of which, the homogeneity of the knit is enhanced in the region of the edge.

At location 94 a further horizontal edge is knitted to the step. This step may be knitted subsequently in knitting the marginal portions together so that any largish opening in the knit is closed. Such a loop may be attached not only horizontally simply by knitting a further loop outwardly, but also vertically, as shown in section 96, by not rendering the outer needle inactive for a loop height. This loop too, may also be subsequently puckered in knitting-together so that a hole may be concealed thereby.

Yet another possibility of closing holes or compensating inhomogenities consists of placing the outer loop(s) of the step, as shown in section 98, to tuck, here too, a very dense homogeneous knit being achievable in the region of the edge.

It is also possibile to provide instead of horizontal tuck loop(s) 98, vertical tuck loop(s) 99, this having the special advantage that more volume materializes in the edge portion, thus providing good concealment of holes.

Not shown in FIG. 6 is the possibility of splitting loops—already shown in FIG. 1—as a result of which likewise the volume and the density of the knit may be enhanced in the region of the fashioning edge or the widening/narrowing edge. The cited possibilities may, of course, be combined by ways and means technologically feasible. By distributing the sections in which a deformation of the knit occurs (FIG. 5) it is likewise possible to harmonize the high homogeneity of the knit with a desired three-dimensional shape.

Referring now to FIG. 8 there is illustrated a two-ply knit 100 in which in the upper ply a fashioning or a widening/narrowing edge 102 is displaced by at least one loop width relative to the edge 104 of the lower ply, as a result of which, inhomogenities in the edge portion are better concealed and better mechanical stability of the knit is achieved.

Referring now to FIG. 9 there is illustrated a corner fashioning. When knitting the course A the loop hanging on needle 1 of the inactivated portion is transferred to the active portion. In addition, the loops hanging on the needles 2 to 5 are shifted one needle to the right. This procedure is repeated until all five loops of the inactivated portion have been transferred to the active portion. In this way a corner is produced in the knit.

In the region of an edge one or more weft and/or warp yarns may be combined from the courses/wales running into the edge into a reinforcement of the edge so that they run along the edge, thus resulting in the edge being reinforced. By using elastic weft or warp yarns the edge portion may be better densified and draped.

It will be understood that the basic techniques as described above, i.e. widening/narrowing, on the one hand, and fashioning, on the other, may, of course, be combined with each other optionally.

Referring now to FIGS. 10 and 11 there is illustrated the technique of narrowing or in the reverse sequence of the method the technique of widening the double planar knits on four-bed machines or two-bed machines with one auxiliary needle bed each for each bed. The needles of the two auxiliary needle beds or of the first and second needle bed are identified by the capital letters A to H. The needles of auxiliary needle beds or of the third and fourth needle bed are identified by a to f. In widening the reverse procedure is run through from f to a.

FIG. 10 is an illustration of narrowing beginning with the needle A of the front and rear main needle bed. The corresponding loops are transferred to the needles a of the outer needle beds. Subsequently in step b of the method the outer needle beds are shifted one needle position to the right, this position being evident from step c in the method. The needles a of the outer needle beds are now located alongside the needles B of the inner needle beds. The loop hanging on the needles a of the outer needle beds is then hung back onto the needle B of the inner needle beds. Subsequently, the outer needle beds are run back to their starting position, i.e. by one position to the left. This starting position is illustrated in step d of the method. It is in this step of the method that now the next loop B is transferred from the inner needle beds to the outer needles b of the outer needle beds. Subsequently, the outer needle beds are again run one position to the right as illustrated in step e of the method so that in the end the position f is reattained. The loop hanging on the needles b of the outer needle beds is then transferred to the needles C of the inner needle beds, after which the outer needle beds are moved back into their starting position.

By means of the method as described above a flat knitting machine having four needle beds is used to achieve a synchronous narrowing or in the reverse sequence of the method a widening of the double planar knit. It is, of course, possible to transfer not just one loop in each case, instead several groups e.g. four loops may be transferred simultaneously to the outer beds depending on the desired staircase shape in widening/narrowing, before then being run four positions to the right and being hung back onto the inner needle beds, this changing especially the marginal portion of widening/narrowing.

Referring now to FIG. 11 there is illustrated an alternative widening/narrowing arrangement to that as shown in FIG. 10. As evident from FIG. 11*a* the loops the loops are not transferred from the inner needle beds to the associated outer needle bed, but to the opposite outer needle bed, i.e. the rear loop on the left is transferred from needle A of the rear, inner needle bed to needle a of the outer, front needle bed. Conversely a loop is transferred from needle A of the front, inner needle bed to needle a of the rear, outer needle bed. Subsequently, analogous to the procedure as shown in FIG. 10, the outer needle beds are run one position to the right and the loops transferred from the outer needle beds to the associated inner needle beds. In step d of the method the loop B of the inner, front and rear needle beds is transferred to needle b of the associated outer needle bed. Subsequently, in turn, the outer needle beds are shifted one position to the right and the loops hung back, but this time unlike the situation as shown in FIG. 10, crosswise, i.e. from needle b of the rear outer needle bed to needle C of the front inner needle bed and from the needle b of the front outer needle bed to needle C of the inner rear needle bed. In this way a particularly intensive interlinking of the two plies is achieved at the point of widening/narrowing. This method too, permits widening when implemented in the reverse sequence, i.e. from f to a. Crossing the edge loops as shown in FIG. 11 provides a novel visual appeal which is particularly important in the case of seat covers, including added stability in the edge portion and better concealment of transfer holes.

In twin needle knitting a particularly dense structure may be attained in the widening/narrowing/fashioning portion when knitting is done in this portion with all needles whilst in the remaining portion knitting is done with only one of the two twin needles. The marginal portion may by contrast be more firmly knitted than the remaining knit portion by defined control of the method. Should narrowing be provided both left and right, this may be done in sequence. It is understood, of course, that all of the hole-closing techniques as described above may be put to use both for widening/narrowing and for fashioning, an even neater finish of the widening/narrowing/fashioning edges being achievable by using split, weft, tuck techniques singly or in combination.

What is claimed is:

1. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, so that the needle bed has an inactive section containing the needles in said portion and an active section adjacent the inactive section, c) placing the loops in the edge region between the active section and the inactive section to tuck, and d) knitting an ending course with needles in said portion of the needle bed active.

2. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein for a multi-ply knit the area of inactivation is shifted by at least one loop in at least two plies.

3. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein weft and/or warp yarns are inserted at least in the inactivated and adjoining active portion to reinforce the knit.

4. The method as set forth in claim 3, wherein a weft yarn is inserted in the last and/or first active course before and/or after inactivation of the needles.

5. The method as set forth in claim 3, wherein the weft yarn is laid to tuck or linked in the adjoining loop(s) of the active portion.

6. The method as set forth in claim 3, wherein the weft yarn is elastic.

7. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein at least one loop in a marginal portion between active portion and inactive portion is split, after which one split loop is assigned to the active portion and one assigned to the inactive portion.

8. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein at least one further loop is knitted to the outer loop before an inactivated portion.

9. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein the outer loop at the edge before an inactivated portion is transferred to an adjacent outer loop of the edge.

10. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein an additional vertical loop is produced at one spickel edge by the outer needle of the inactivated portion following an active portion not being rendered inactive.

11. A method of producing a three-dimensional knit on a knitting machine having a needle bed including needles, said method comprising:

a) knitting a starting course with the needles in a portion of the needle bed active, b) knitting at least one intermediate course with needles in said portion of the bed inactive, and c) knitting an ending course with needles in said portion of the needle bed active, wherein a loop arranged at a fashioning edge is placed to tuck.

12. The method as set forth in claim 1, wherein activation and subsequent activation of needles is done over several courses successively in minor steps up to a defined maximum width.

13. The method as set forth in claim 2, wherein activation and subsequent activation of needles is done over several courses successively in minor steps up to a defined maximum width.

14. The method as set forth in claim 3, wherein activation and subsequent activation of needles is done over several courses successively in minor steps up to a defined maximum width.

15. The method as set forth in claim 7, wherein activation and subsequent activation of needles is done over several courses successively in minor steps up to a defined maximum width.

16. The method as set forth in claim 8, wherein activation and subsequent activation of needles is done over several courses successively in minor steps up to a defined maximum width.

17. The method as set forth in claim 9, wherein activation and subsequent activation of needles is done over several courses successively in minor steps up to a defined maximum width.

18. The method as set forth in claim 10, wherein activation and subsequent activation of needles is done over several courses successively in minor steps up to a defined maximum width.

19. The method as set forth in claim 11, wherein activation and subsequent activation of needles is done over several courses successively in minor steps up to a defined maximum width.

* * * * *